US007927060B2

(12) United States Patent
Biggerstaff et al.

(10) Patent No.: US 7,927,060 B2
(45) Date of Patent: Apr. 19, 2011

(54) PRIORITY HYDRAULIC FLOW DIVERTER CONTROL ASSEMBLY

(75) Inventors: Jimmy M. Biggerstaff, Pauline, SC (US); James Abbott Garrett, Greensboro, NC (US)

(73) Assignee: Bayne Machine Works, Inc., Greenville, SC (US)

( * ) Notice: Subject to any disclaimer, the term of this patent is extended or adjusted under 35 U.S.C. 154(b) by 1219 days.

(21) Appl. No.: 11/346,980

(22) Filed: Feb. 3, 2006

(65) Prior Publication Data

US 2006/0245881 A1 Nov. 2, 2006

Related U.S. Application Data

(60) Provisional application No. 60/650,021, filed on Feb. 4, 2005.

(51) Int. Cl.
*B65B 21/02* (2006.01)

(52) U.S. Cl. ..... 414/408; 414/810; 91/516

(58) Field of Classification Search ..... 414/466, 414/525.2–525.55, 812, 408, 810; 91/516; 137/115.13, 115.18
See application file for complete search history.

(56) References Cited

U.S. PATENT DOCUMENTS 3,722,858 A * 3/1973 Sugimoto et al. ..... 251/209
3,889,340 A * 6/1975 Dixon, Jr. ..... 72/416
4,042,134 A * 8/1977 Smith ..... 414/525.54
4,070,857 A * 1/1978 Wible ..... 60/422
4,176,685 A * 12/1979 Hoefer et al. ..... 137/596.13
4,213,300 A * 7/1980 Biskis ..... 60/420
4,230,359 A * 10/1980 Smith ..... 296/101
4,449,365 A * 5/1984 Hancock ..... 60/422
4,573,319 A * 3/1986 Chichester ..... 60/422
4,687,405 A * 8/1987 Olney ..... 414/408
4,977,928 A * 12/1990 Smith et al. ..... 137/596
5,135,020 A * 8/1992 Rausch ..... 137/115.18
5,617,724 A * 4/1997 Ko ..... 60/422
5,927,072 A * 7/1999 Vannette ..... 60/452
6,182,771 B1 * 2/2001 Nakamura et al. ..... 172/431
6,938,415 B2 * 9/2005 Last ..... 60/432
2003/0100831 A1 * 5/2003 Kuriyama et al. ..... 600/435

* cited by examiner

*Primary Examiner* — Saúl J Rodriguez
*Assistant Examiner* — Glenn Myers
(74) *Attorney, Agent, or Firm* — McAndrews, Held & Malloy, Ltd.

(57) ABSTRACT

A priority hydraulic flow diverter control assembly for a refuse collection vehicle hydraulic system provides proper and efficient flow in an auxiliary hydraulic circuit regardless of the primary flow so that refuse cart lifters and the refuse cart operate safely and efficiently. A pressure sequence valve diverts hydraulic fluid flow from the refuse cart lifter circuit into the downstream main hydraulic system when downstream back pressure is low, and into the system tank when back pressure is high. This allows all hydraulic operated equipment to operate at their intended speed whether at high or low system back pressure.

A differential pressure sensing valve and flow regulating valves provide a precision flow. Harmful and undesirable vibrations and noise associated with pulses in hydraulic system pressure are reduced using a control orifice located in the valve body. A relief valve ensures that the diverter control assembly is compatible with other manufacturer's products.

22 Claims, 12 Drawing Sheets

PRIORITY HYDRAULIC FLOW DIVERTER CONTROL ASSEMBLY

RELATED APPLICATIONS

This application makes reference to, claims priority to, and claims the benefit of U.S. Provisional Patent Application Ser. No. 60/650,021, entitled "Priority Hydraulic Flow Diverter Valve", filed Feb. 4, 2005, the complete subject matter of which is hereby incorporated herein by reference in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

The present invention relates to hydraulic systems, and in particular to hydraulic systems used on refuse collection vehicles to compact refuse and operate auxiliary hydraulic equipment such as refuse cart lifting devices.

Refuse collection vehicle hydraulic systems are primarily used to operate a ram that drives a packer panel, which compacts refuse dumped into the refuse collection vehicle's hopper. Many refuse collection vehicles are often also equipped with hydraulically operated auxiliary equipment such as refuse cart lifters. Refuse cart lifters are commonly known as lifters or tippers because they assist the vehicle operator in lifting and tipping heavy refuse carts into the refuse collection vehicle hopper or intermediate container.

A flow diverting apparatus, is commonly used to divert hydraulic fluid flow out of the main hydraulic system into the lifter circuit that operates these refuse cart lifting devices. The use of a flow-diverting apparatus, such as a diverter control assembly, to control hydraulic fluid flow to auxiliary hydraulic circuits is well known to those familiar with the design and operation of hydraulic systems.

Flow can be diverted by numerous means. The simplest method involves nothing more than a tee fitting placed in line of one of the pressure lines, with the primary flow directed towards the packer panel ram and the tee flow being directed to the lifter circuit. There are, however, several problems associated with this type of simple system. For example, the simple tee system will not maintain a consistent flow to the refuse cart lifters. The flow to the refuse cart lifters will be proportional to the flow to the downstream functions (such as the refuse collection vehicle packer ram) based on the size of the hydraulic lines and the downstream back pressure.

As inlet flow increases, the outlet flows increase and remain proportional to each other. This is because mobile refuse collection equipment typically utilizes a positive displacement "power take off" pump to provide refuse collection vehicle hydraulic system flow and pressure. The amount of hydraulic fluid flow in the system varies with the speed of the pump, and the pump speed directly corresponds to the refuse collection vehicle engine speed. Thus, the simple tee system cannot control the amount of hydraulic fluid flow to the refuse cart lifters as pump speeds vary.

Hydraulic refuse cart lifters require more precise control of hydraulic fluid flow. The time of the refuse cart lifter operating cycle is critical to performance, life of the refuse cart lifter, and life of the refuse cart. Most refuse cart lifters require a flow of 2 to 2.5 gallons per minute (gpm). The simple tee system can be improved by placing an orifice in the outlet line to the refuse cart lifters. This will change the proportion of flow and restrict the flow to a more suitable level.

For example, diverter control assemblies may use a priority flow valve containing an orifice. However, the pressure required to operate the priority flow valve is high, causing a pressure drop across the block. In order to maintain a controlled flow to two refuse cart lifters, a flow divider valve may be used to evenly divide the flow provided by the priority flow valve. However, when the refuse cart lifter bottoms out or the flow divider valve fails, the priority flow valve will shut down flow to downstream functions.

Moreover, this configuration can require significantly more pressure to operate than the priority flow valve. In fact, the pressure drop is more than doubled in the dual refuse cart lifter configuration. The combination of the two devices causes the pressure drop in the valve to be very high (as high as 350 to 400 psi, or more in certain instances). However, all mobile refuse equipment is not the same. System flow rates can range from less than 20 gpm to more than 60 gpm. The simple tee system is therefore often equipped with an adjustable orifice so that the flow can be fine tuned to make the flow to the refuse cart lifters acceptable regardless of the flow coming in to the tee. This relatively inexpensive type of flow diverter technology is currently used in many systems, but presents many disadvantages when used to control flow to refuse cart lifters.

For example, once the flow to the refuse cart lifters is adjusted, it will still allow for the flow to vary with the primary system flow. This will cause the refuse cart lifters to operate at different speeds relative to the primary system flow. Moreover, the use of a variable orifice results in a significant pressure drop across the system. This causes a reduction in the pressure available to downstream operations and can noticeably affect their operation and performance.

Furthermore, the additional work being done to move the oil through this restriction is dissipated through heat. The addition of heat to the hydraulic system is generally unacceptable as it also reduces the performance of the system. It can also be dangerous and lead to potential component failures and possibly system fires. Finally, if the adjustable orifice is improperly adjusted, it may allow the refuse cart lifters to cycle too quickly and lead to premature lifter failure and cart damage, or even personal injury.

BRIEF SUMMARY OF THE INVENTION

The present priority hydraulic flow diverter control assembly eliminates many disadvantages of existing mobile refuse hydraulic flow control systems and gives flow priority to the auxiliary hydraulic circuit, regardless of the incoming flow. The present priority hydraulic flow diverter control assembly may provide precise flow regardless of the primary hydraulic system flow so that the refuse cart lifter and the refuse cart may operate properly and efficiently.

The present priority hydraulic flow diverter control assembly uses a differential pressure sensing valve and flow regulating valves to provide a precision flow. The flow regulating valves employ an orifice to meter hydraulic fluid flow to the refuse cart lifters. The differential pressure sensing valve may reduce the pressure differential across the flow regulating valve, but may also maintain the pressure differential required to allow the flow regulating valves to operate properly.

The failure mode of the differential pressure sensing valve and flow regulating valves may also be such that the valve can not block the downstream flow in any way. A relief valve may be used to ensure that the unit is compatible with other manufacturer's products.

A control orifice in the priority flow hydraulic diverter control assembly may stabilize the differential pressure sensing valve to keep it from modulating erratically which reduces vibrations and noise. The control orifice may compensate for flow variations due to pump characteristics in individual applications.

A pressure sequence valve may enable the system to operate in the most efficient manner with respect to pressure drop and flow loss. The pressure sequence valve may divert the hydraulic fluid into a line downstream of the refuse cart lifters when the downstream back pressure is low. This allows the hydraulically operated equipment in the refuse collection vehicle hydraulic system to operate at their intended speed. When the back pressure climbs to a predetermined set point, the pressure sequence valve may sense the increased back pressure and diverts the flow leaving the refuse cart lifters to the hydraulic system reservoir or tank. This may result in a significantly reduced pressure drop across the priority flow hydraulic diverter control assembly.

The design of the present priority flow hydraulic diverter control assembly may prevent variation of the hydraulic fluid flow in the refuse cart lifter hydraulic circuit as the pressure varies in the main refuse collection vehicle hydraulic system or packer ram hydraulic circuit. Thus, the refuse cart lifters may operate at a consistent speed relative to the primary system flow. This may prevent excessively fast cycle times that may cause personal injury, and prolongs the life of the refuse cart lifter and the refuse carts. The significant reduction in the pressure drop across the priority flow hydraulic diverter control assembly greatly reduces the work required to move hydraulic fluid through the orifice in the flow regulating valve that can lead to potential component failures and possibly system fires.

DETAILED DESCRIPTION OF THE INVENTION

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on or with another embodiment to yield a still further embodiment. Thus, it is intended that the present invention cover such modifications and variations. Other objects, features and aspects of the present invention are disclosed in or are apparent from the following detailed description. It is to be understood by one of ordinary skill in the art that the present discussion is a description of exemplary embodiments only, and is not intended as limiting the broader aspects of the present invention.

Figure 1:
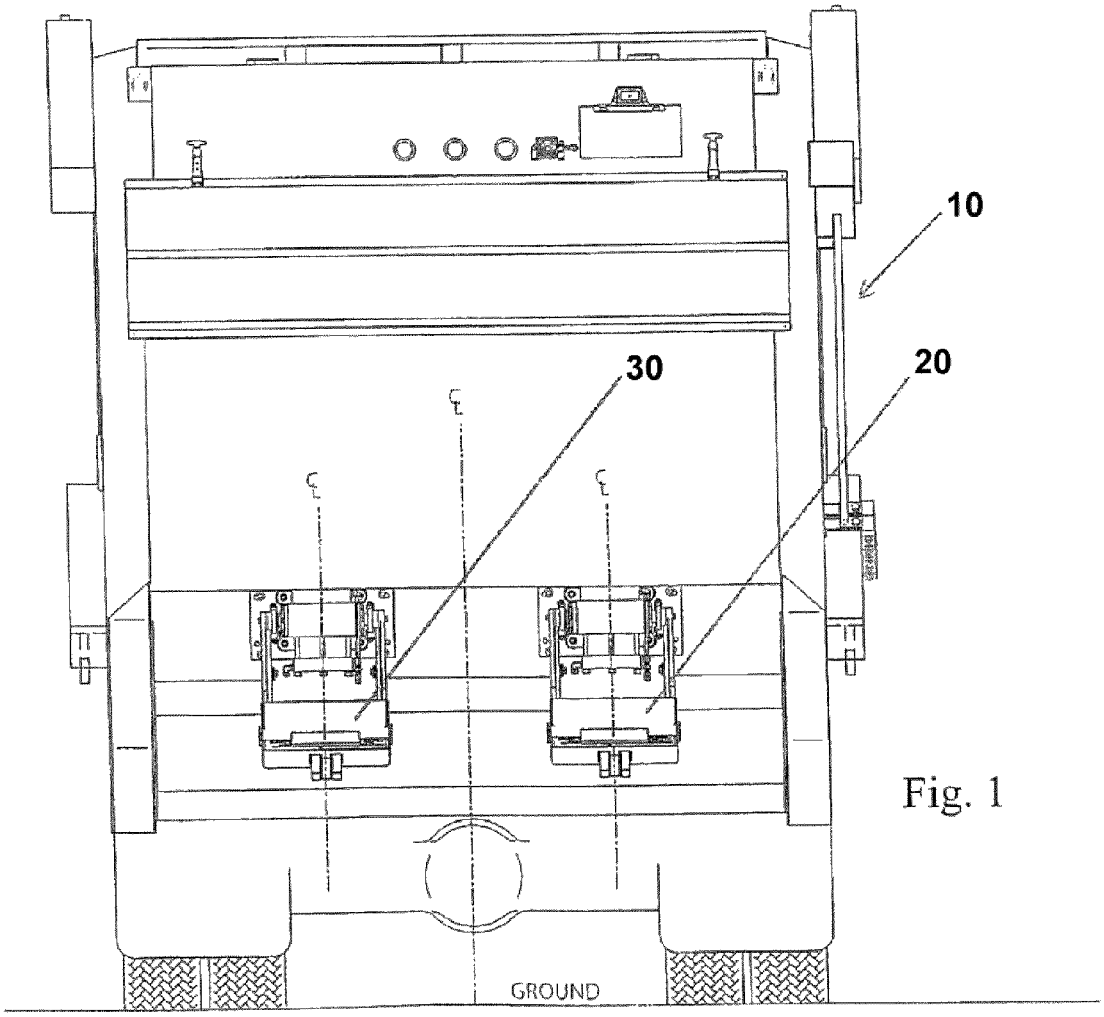
FIG. 1 is an elevated rear view of a refuse collection vehicle equipped with two refuse cart lifters mounted to the rear of the vehicle.

Referring to FIG. 1, a refuse collection vehicle 10 is equipped with a first refuse cart lifter 20 and a second refuse cart lifter 30. Refuse cart lifters 20 and 30 depicted in FIG. 1 are of a type manufactured by Bayne Machine Works, Inc. that are designed to lift refuse carts having an upper and a lower grab bar (not shown). This type of refuse cart lifter is shown by way of example only. The particular type of refuse cart lifter is not essential to the present priority flow hydraulic diverter control assembly. Furthermore, although refuse cart lifters 20 and 30 are depicted as mounted on the rear of the refuse collection vehicle, the present invention is equally applicable to lifters mounted at other locations on the refuse collection vehicle, e.g. the side of a side-loading refuse collection vehicle (not shown) or the front or side of a front-loading refuse collection vehicle utilizing an intermediate container (not shown). Accordingly, the term "refuse collection vehicle" is not limited to the rear-loading refuse collection vehicle 10 of FIG. 1.

Figure 2:
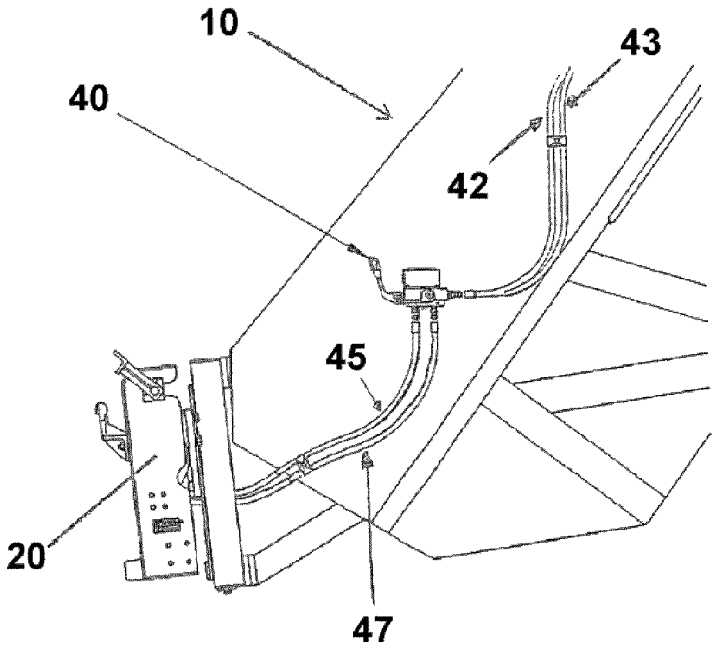
FIG. 2 is a side view of refuse collection vehicle equipped with a refuse cart lifter mounted to the rear of the vehicle.
Figure 3:
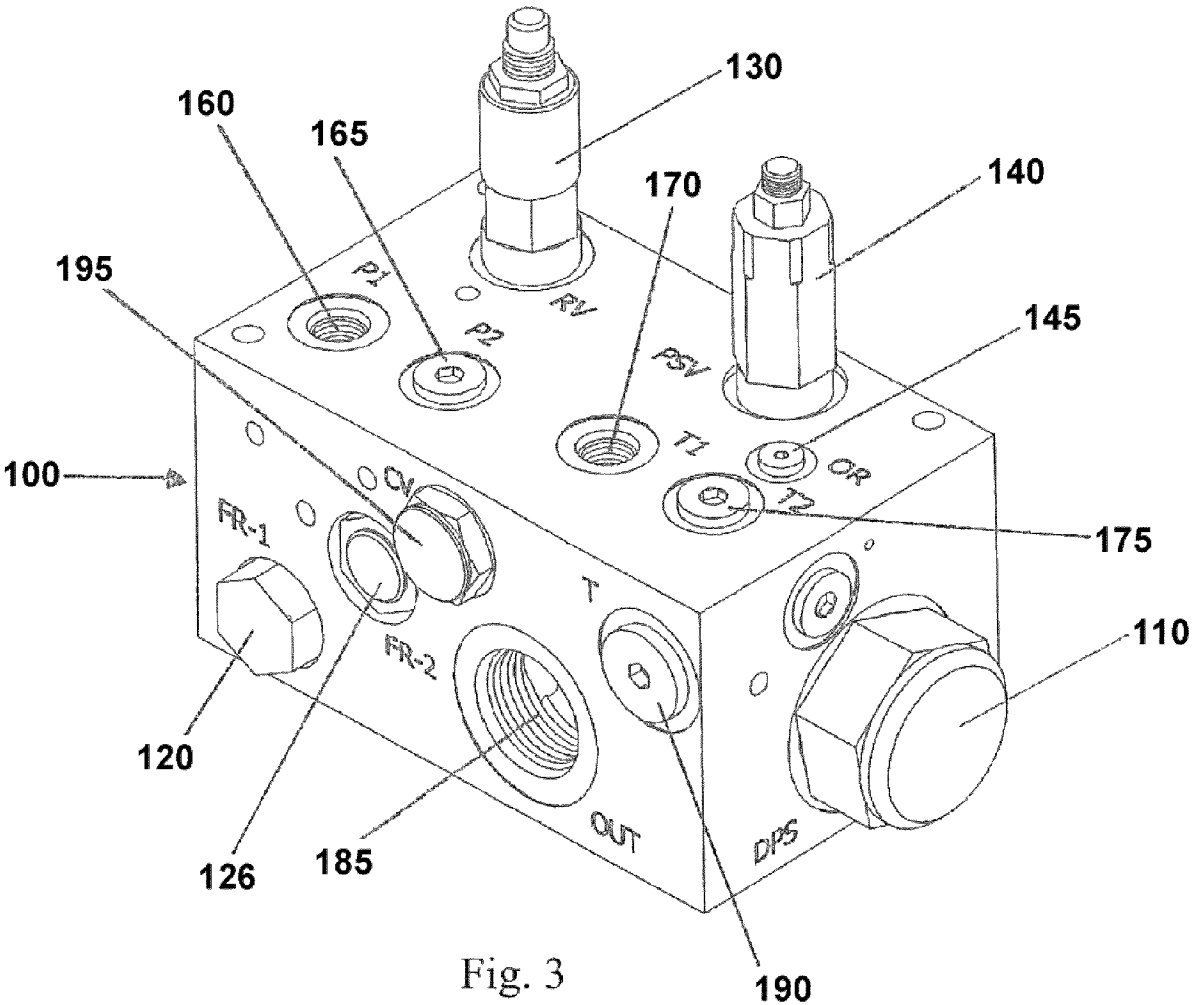
FIG. 3 is a first perspective view of the present priority flow diverter control assembly.

FIG. 2 is a side view of the rear portion of rear-loading refuse collection vehicle 10 depicted in FIG. 1, including a first hand valve 40 and first refuse cart lifter 20. Hydraulic fluid is supplied to a first hand valve 40 through hydraulic line 42. Hand valve 40 can be operated to direct hydraulic fluid flow through hydraulic line 45 to raise some part of refuse cart lifter 20, or through hydraulic line 47 to lower some part of refuse cart lifter 20. The hydraulic fluid that flows to refuse cart lifter 20 through line 45 or line 47 returns to hand valve 40 through line 47 or 45 respectively, and returns to the hydraulic system from hand valve 40 through hydraulic line 43.

FIGS. 3 through 7 depict a preferred embodiment of present priority flow hydraulic diverter control assembly 100 configured to divert hydraulic fluid flow to first refuse cart lifter 20. The present priority flow hydraulic diverter control assembly 100 can also be configured to divert hydraulic fluid flow to dual refuse cart lifters as later discussed in reference to FIGS. 11 and 12. It should be understood that although the priority flow hydraulic diverter control assembly is depicted using threaded modular components, the various components may also be otherwise operatively connected to the present priority flow hydraulic diverter control assembly. By way of example only, the various valves and orifices described may be machined into the priority flow hydraulic diverter control assembly without departing from the scope of the invention.

Figure 4:
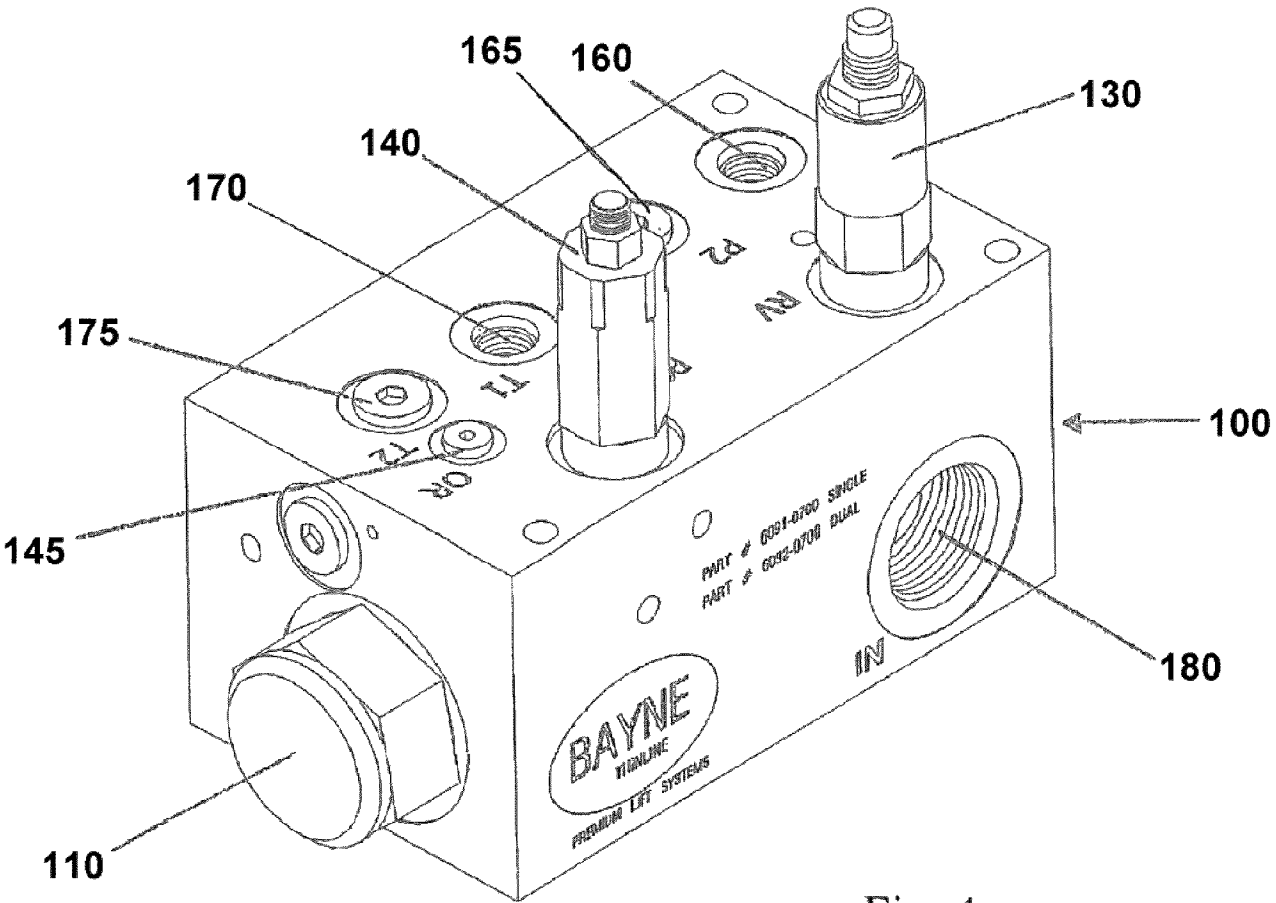
FIG. 4 is a second perspective view of the present priority flow diverter control assembly.
Figure 5:
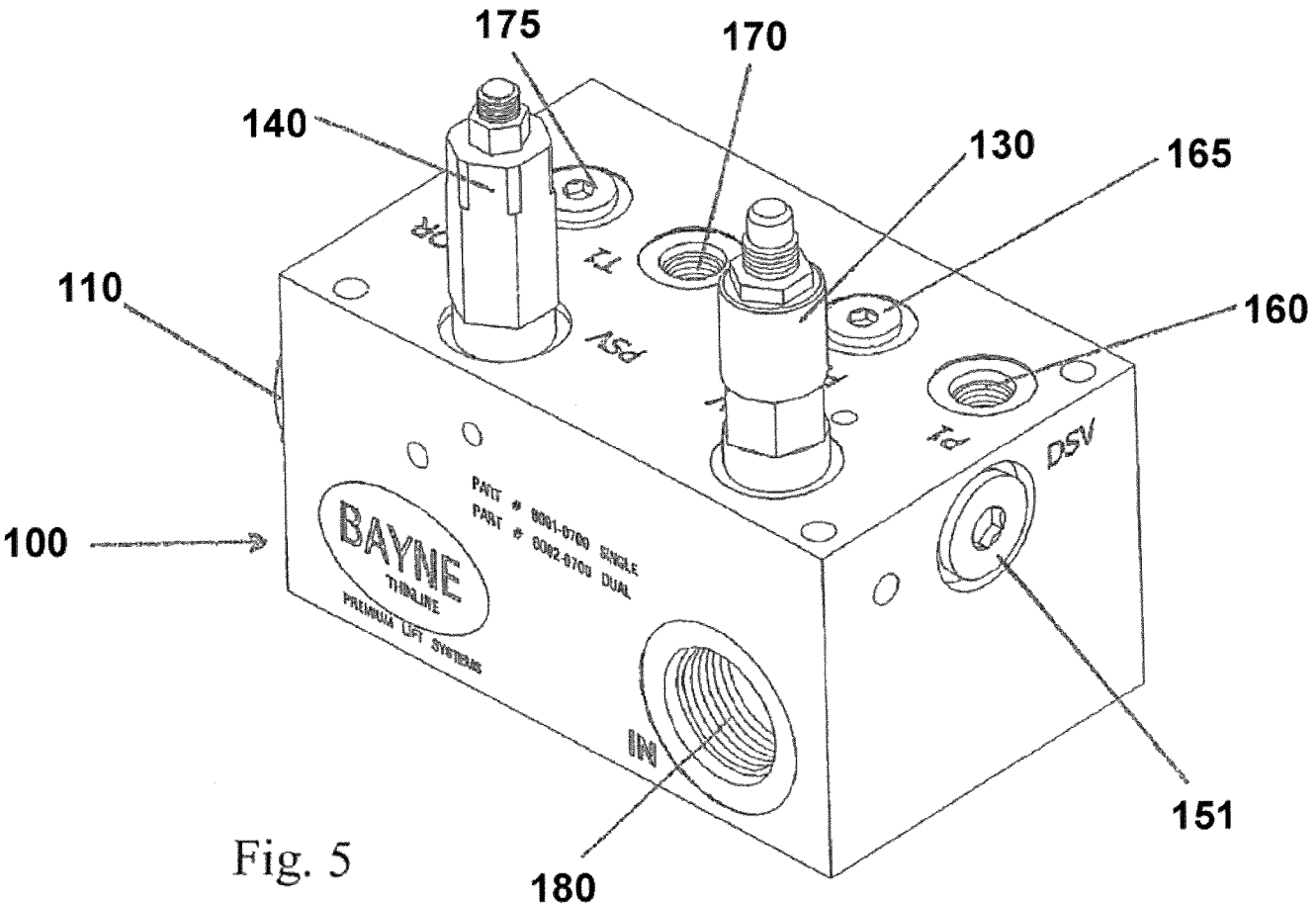
FIG. 5 is a third perspective view of the present priority flow diverter control assembly.
Figure 6:
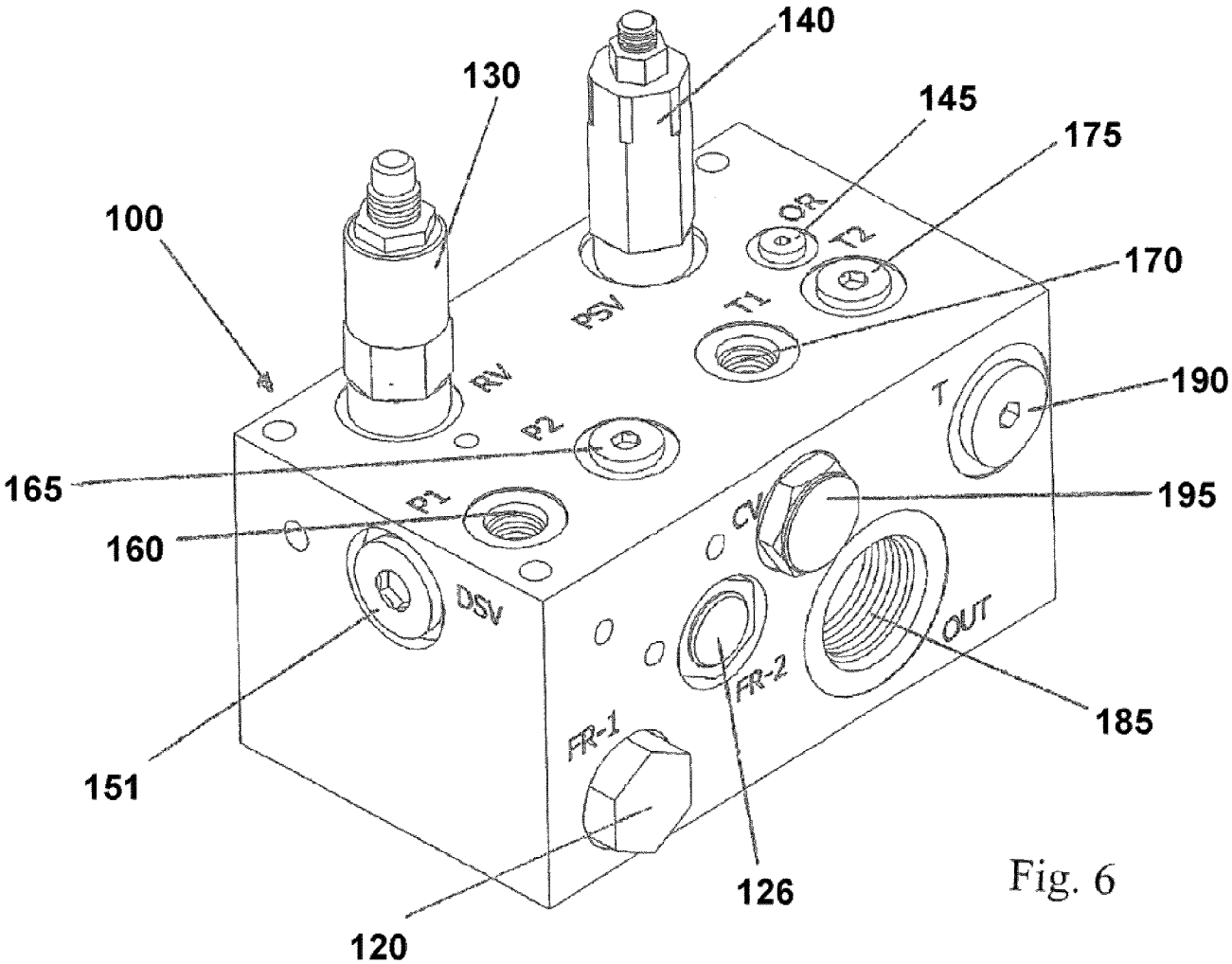
FIG. 6 is a fourth perspective view of the present priority flow diverter control assembly.
Figure 7:
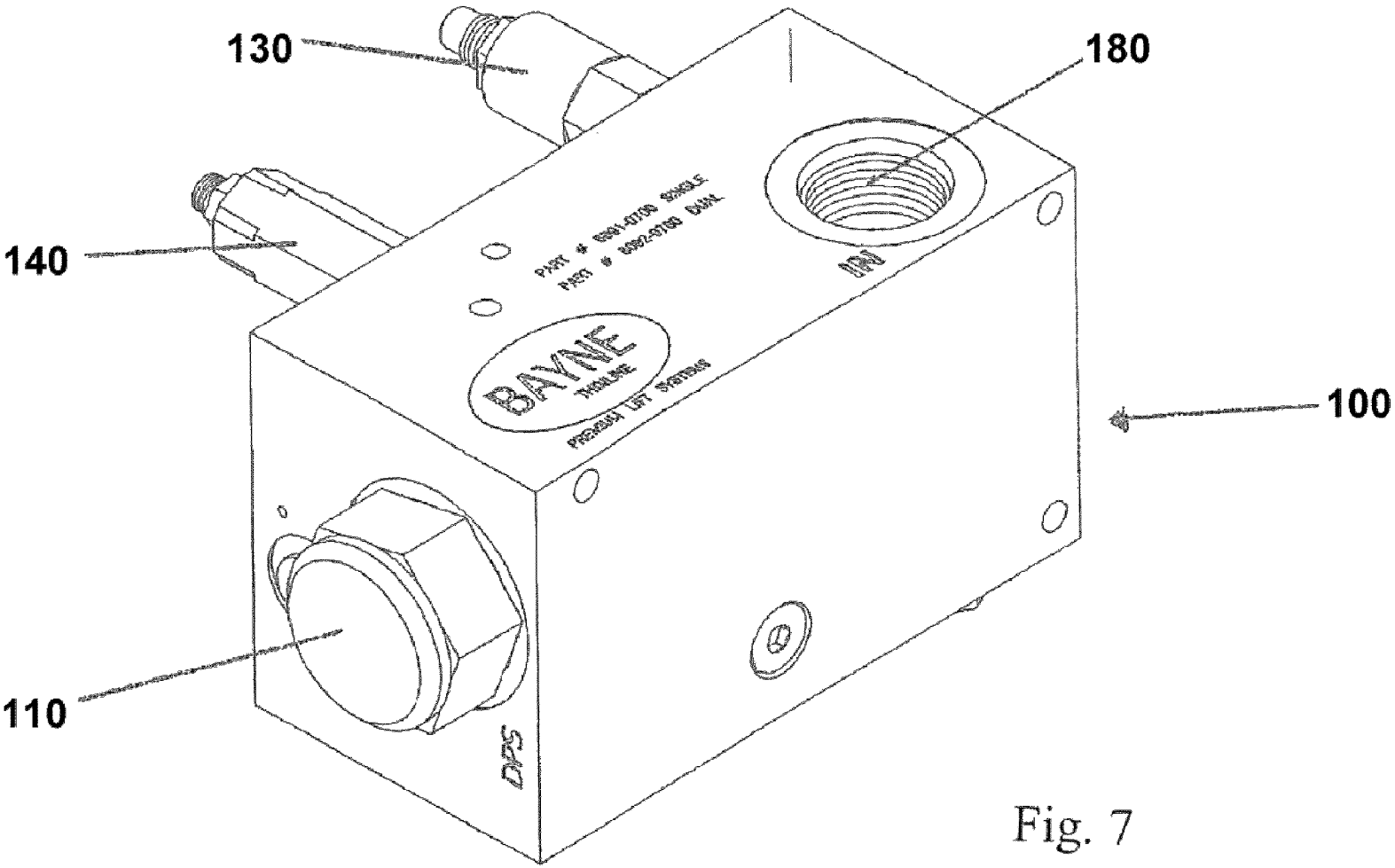
FIG. 7 is a fifth perspective view of the present priority flow diverter control assembly.

Turning to FIG. 4, hydraulic fluid from the main hydraulic system of refuse collection vehicle 10 enters priority flow hydraulic diverter control assembly 100 through threaded inlet port 180. Hydraulic fluid flows out of priority flow hydraulic diverter control assembly 100 to first refuse cart lifter 20 through threaded port 170, and returns to priority flow hydraulic diverter control assembly 100 through threaded port 160 (see also FIG. 3).

If priority flow hydraulic diverter control assembly 100 is configured for a second refuse cart lifter 30, hydraulic fluid may also flow out of priority flow hydraulic diverter control assembly 100 to refuse cart lifter 30 through threaded port 175 (shown plugged in FIGS. 3 through 8), and return to priority flow hydraulic diverter control assembly 100 through threaded port 165 (shown plugged in FIGS. 3-6 and 8).

Hydraulic fluid exits priority flow hydraulic diverter control assembly 100 into the main hydraulic system through threaded outlet port 185. Threaded outlet port 190 (plugged in FIGS. 3, 6 and 8) may be connected to the hydraulic system tank 192 (see FIGS. 10 and 12).

Priority flow hydraulic diverter control assembly 100 components include a differential pressure sensing valve 110, and a first flow regulating valve 120. Both differential pressure sensing valve 110 and first flow regulating valve 120 are threaded into priority flow hydraulic diverter control assembly 100. First flow regulating valve 120 contains an orifice sized to assist in maintaining the desired flow rate to refuse cart lifter 20. Refuse cart lifters typically require a flow rate of 2.0 to 2.5 gpm. A threaded port 125 for a second flow regulating valve 127 (see FIG. 8) is shown blocked by second flow regulating valve plug 126. In a dual refuse cart lifter configuration, second flow regulating valve 127 would be installed in place of second flow regulating valve plug 126 (see FIGS. 8, 11 and 12).

Differential pressure sensing valve 110 is a spring-loaded valve designed to establish flow through flow regulating valve 120 at low hydraulic pressures, and open a path around flow regulating valve 120 at high hydraulic pressures. Thus, differential pressure sensing valve 110 establishes the necessary pressure drop that is required to allow flow regulating valve 120 to operate properly, without generating an excessively high differential pressure across flow regulating valve 120. Using differential pressure sensing valve 110, the pressure drop across flow regulating valve 120 can be reduced to as low as 120 pounds per square inch (psi) in any configuration.

Figure 8:
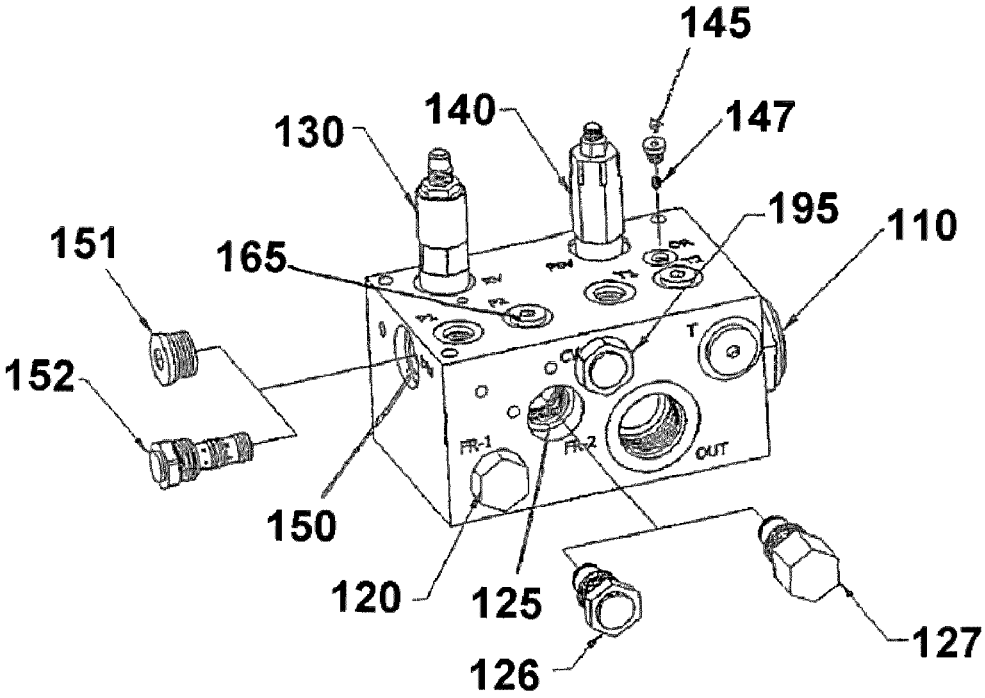
FIG. 8 is a sixth perspective view of the present priority flow diverter control assembly.
Figure 9:
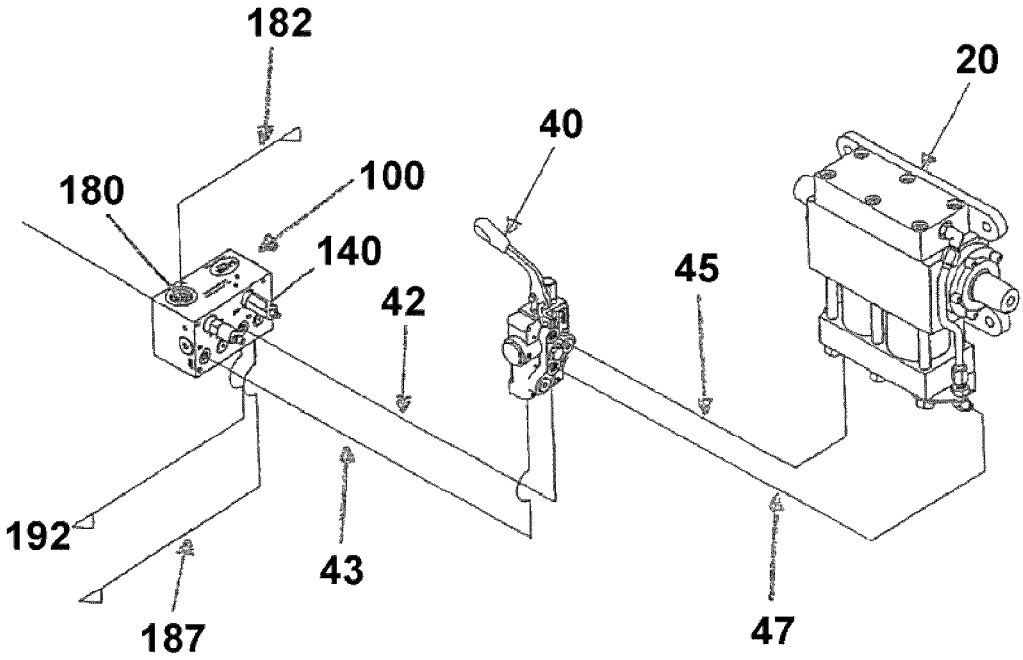
FIG. 9 is a perspective view illustrating the hydraulic connections between the present priority hydraulic flow diverter control assembly and a hand valve controlling a single refuse cart lifter.

Threaded fitting 145 secures control orifice 147 in priority flow hydraulic diverter control assembly 100 (FIG. 8). The pressure downstream of control orifice 147 adds to the spring force of differential pressure sensing valve 110 opposing the force on differential pressure sensing valve 110 resulting from the pressure in line 182 (FIG. 9). Control orifice 147 (FIG. 8) is included to prevent differential pressure sensing valve 110 from modulating erratically when used in different existing hydraulic systems. Erratic modulation is caused by pressure pulses resulting from slippage of the hydraulic pump in some systems. As the pressure increases and decreases with the frequency of the pressure pulses, the pressure downstream of control orifice 147 acts as feedback to differential pressure sensing valve 110 to prevent severe modulations in the pressure differential across flow regulating valve 120.

Control orifice 147 may also be machined into priority flow hydraulic diverter control assembly 100 (not shown) and may prevent erratic modulation in most applications. In some cases, however, a particular hydraulic system may require a different size orifice to correct the unique modulation of the system. Thus, a single control orifice that is adjustable in size (not shown) may be used to try to match the characteristics of each individual truck hydraulic system. Preferably, however, a non-adjustable control orifice 147 that can be swapped out for a different sized non-adjustable control orifice 147 is preferred.

Priority flow hydraulic diverter control assembly 100 also includes an adjustable, spring-loaded relief valve 130 that is designed to relieve hydraulic pressure within priority flow hydraulic diverter control assembly 100 when a particular hydraulic pressure is reached. Hydraulic pressure within priority flow hydraulic diverter control assembly 100 may rise dramatically for several reasons. For example, hydraulic pressure within priority flow hydraulic diverter control assembly 100 will greatly increase when flow through priority flow hydraulic diverter control assembly 100 is blocked. This can occur when the operator of refuse cart lifter 20 "bottoms out" hand valve 40 (FIG. 2).

Hydraulic pressure within priority flow hydraulic diverter control assembly 100 will also greatly increase if refuse cart lifter 20 is attempting to lift a particularly heavy refuse cart. Moreover, the attempted lifting of such a heavy refuse cart may damage the refuse cart. Thus, relief valve 130 is typically adjusted to relieve hydraulic pressure within priority flow hydraulic diverter control assembly 100 that occurs when refuse cart lifter 20 attempts to lift a refuse cart weighing 350 lbs or greater.

Pressure sequence valve 140 and relief valve 130 are preferably manufactured using different thread sizes to prevent the accidental switching of pressure sequence valve 140 and relief valve 130 during assembly of priority flow hydraulic diverter control assembly 100. Incorrect assembly could ultimately cause equipment damage or personal injury.

Pressure sequence valve 140 enables the system to operate in the most efficient manner with respect to pressure drop and flow loss. Pressure sequence valve 140 senses the pressure from the main hydraulic system within priority flow hydraulic diverter control assembly 100 near outlet port 185. Pressure sequence valve 140 recycles hydraulic fluid from refuse cart lifter 20 back to the main hydraulic system for use in driving the refuse collection vehicle packer ram, or other hydraulic equipment, when the pressure sensed in the main hydraulic system is low enough to permit the desired hydraulic fluid flow through refuse cart lifter 20.

At a predetermined set point (typically where the pressure in the main hydraulic system is too high to permit enough hydraulic fluid flow through refuse cart lifter 20 to maintain normal lifter speed), pressure sequence valve 140 directs the fluid flow from refuse cart lifter 20 through outlet port 190 to the hydraulic system tank 192. Thus, proper lifter speed may be maintained both above and below the predetermined set point. Packer ram operation is not significantly affected at this point because the hydraulic fluid flow required by the packer ram is typically low when the main hydraulic system pressure is high. The predetermined set point of pressure sequence valve 140 will vary by individual system, but many systems operate at a predetermined set point of around 1300 psi.

Figure 10:
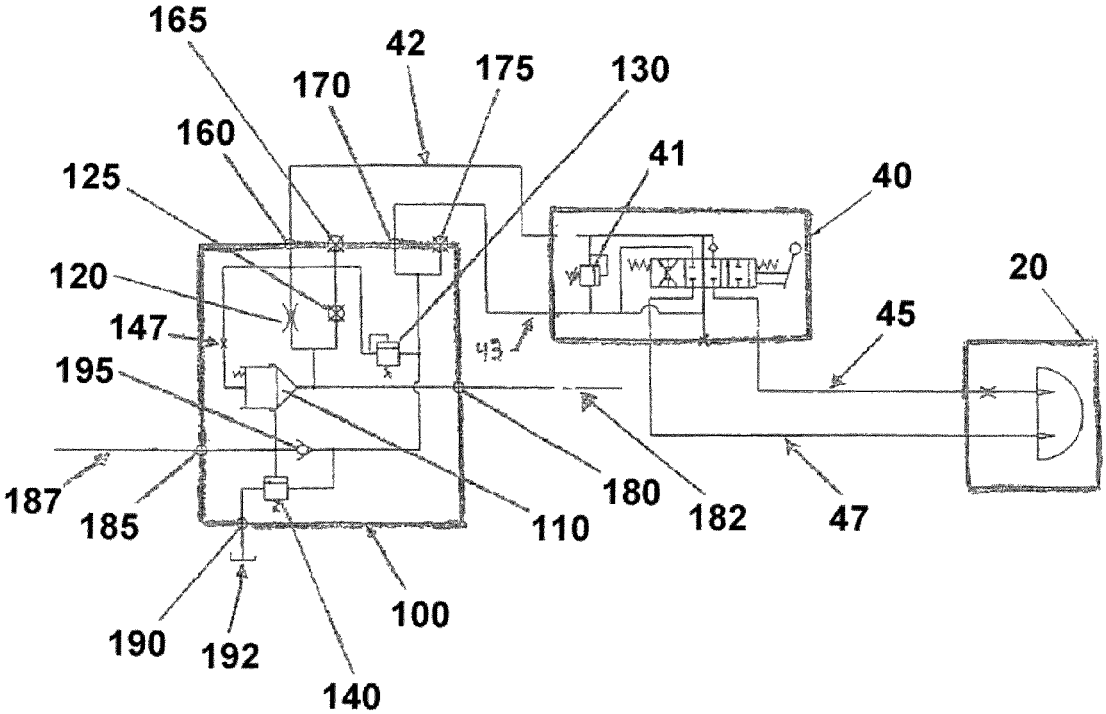
FIG. 10 is a line schematic illustrating the components and hydraulic flow path associated with the present priority hydraulic flow diverter control assembly when configured for use with a single refuse cart lifter.
Figure 12:
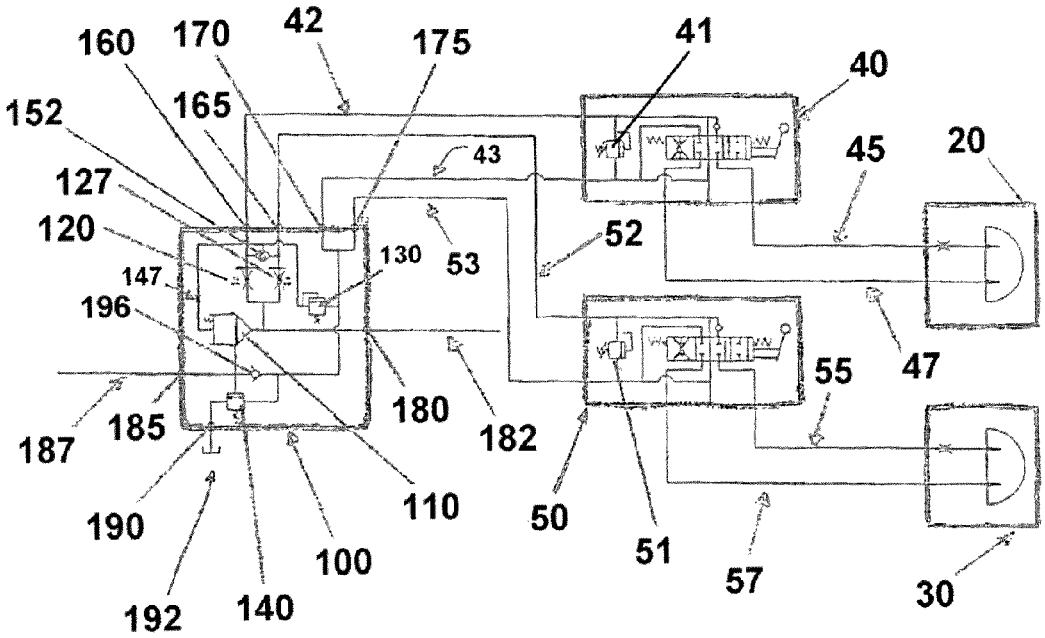
FIG. 12 is a line schematic illustrating the components and hydraulic flow path associated with the present priority hydraulic flow diverter control assembly when configured for use with dual refuse cart lifters.

In the preferred embodiment, a spring force in pressure sequence valve 140 mechanically opposes the hydraulic force exerted by the hydraulic pressure from the main hydraulic system (see FIGS. 10 and 12). Alternatively, an electronic signal representing the hydraulic pressure in the main hydraulic system generated by a pressure transducer (not shown) or the like may be compared against a predetermined electronic set point to direct flow through pressure sequence valve 140.

A check valve 195 is threaded into priority flow hydraulic diverter control assembly 100. Check valve 195 prevents back flow from the main hydraulic system into priority flow hydraulic diverter control assembly 100 through outlet port 185.

A threaded port 150 (shown in FIG. 8) designed to accept a dual sequence valve 152 is machined into priority flow hydraulic diverter control assembly 100. Dual sequence valve plug 151 is shown installed in the single lifter configuration depicted in FIGS. 5 and 6. Dual sequence valve 152 replaces dual sequence valve plug 151 in a dual lifter configuration (see FIG. 8).

Dual sequence valve 152 is needed in the dual lifter configuration because if first refuse cart lifter 20 is building more pressure than the second refuse cart lifter 30, e.g. because first refuse cart lifter 20 is lifting a heavier refuse cart than second refuse cart lifter 30, second refuse cart lifter 30 may not receive sufficient flow to operate properly. To correct this situation, dual sequence valve 152 directs hydraulic fluid flow from downstream of first flow regulating valve 120 to provide hydraulic feedback to differential pressure sensing valve 110 and raise the hydraulic pressure upstream of flow regulating valves 120 and 127. This helps to maintain the operability of both refuse cart lifters 20 and 30 despite the increased pressure build up associated with first refuse cart lifter 20.

FIG. 9 depicts the hydraulic connection between the main components of a typical refuse cart lifter hydraulic circuit configured to operate a first refuse cart lifter 20. The refuse collection vehicle hydraulic system pump (not shown) pumps hydraulic fluid through supply line 182 and into priority flow hydraulic diverter control assembly 100 at threaded connection 180. Hydraulic fluid flow metered by priority flow hydraulic diverter control assembly 100 flows to a first hand valve 40 through line 42. Depending on the position of first hand valve 40, hydraulic fluid flow may continue to first refuse cart lifter 20 through line 45 if first refuse cart lifter 20 is being raised, or line 47 if first refuse cart lifter 20 is being lowered. If first hand valve 40 is positioned to block hydraulic fluid flow to first refuse cart lifter 20, hydraulic fluid flow may be diverted to an outlet of priority flow hydraulic diverter control assembly 100 via diverter control assembly relief valve 130 or first hand valve relief valve 41 (see FIG. 10).

Hydraulic fluid flow from first refuse cart lifter 20 returns to first hand valve 40 through line 47 if first refuse cart lifter 20 is being raised, or line 45 if first refuse cart lifter 20 is being lowered. Hydraulic fluid returned to first hand valve 40 flows back to priority flow hydraulic diverter control assembly 100 through line 43. Hydraulic fluid from priority flow hydraulic diverter control assembly 100 returns to either the main hydraulic system through line 187 or the hydraulic system tank 192. The flow path from priority flow hydraulic diverter control assembly 100 depends upon the position of pressure sequence valve 140.

Turning to FIG. 10, this figure is helpful in understanding the operation of priority flow hydraulic diverter control assembly 100 and its individual components, including the hydraulic fluid flow path within priority flow hydraulic diverter control assembly 100 when priority flow hydraulic diverter control assembly 100 is configured to operate a first refuse cart lifter 20.

The refuse collection vehicle hydraulic system pump (not shown) pumps hydraulic fluid through supply line 182 and into priority flow hydraulic diverter control assembly 100 at threaded connection 180. Flow is then directed into first flow regulating valve 120. A portion of the flow out of flow regulating valve 120 is metered by control orifice 147 to differential pressure sensing valve 110. If the hydraulic pressure in line 182 is high enough to overcome the spring force of differential pressure sensing valve 110 and the force applied to differential pressure sensing valve 110 by pressure downstream of control orifice 147, a portion of the flow from line 182 will flow through differential pressure sensing valve 110 to main hydraulic supply line 187. This keeps the differential pressure across priority flow hydraulic diverter control assembly 100 low, but adequate for refuse cart lifter operation.

Hydraulic fluid exits priority flow hydraulic diverter control assembly 100 at threaded port 160 and flows towards first hand valve 40. If the hydraulic pressure downstream of flow regulating valve 120 is high enough to overcome the spring force of relief valve 130 or hand valve relief valve 41, i.e. meets or exceeds the set point of relief valves 130 or 41, hydraulic fluid will flow either back to the main hydraulic system through port 185 or to the hydraulic system tank 192 through port 190. The flow path taken by the hydraulic fluid from the outlet of relief valve 130 is dependent on the set point of pressure sequence valve 140 and the hydraulic pressure in line 187. If the hydraulic pressure in line 187 is high enough to overcome the spring force of pressure sequence valve 140, i.e. meets or exceeds the predetermined set point of pressure sequence valve 140, hydraulic fluid will flow to the hydraulic system tank 192 through port 190. If the hydraulic pressure in line 187 is not high enough to overcome the spring force of pressure sequence valve 140, i.e. is below the predetermined set point of pressure sequence valve 140, hydraulic fluid will flow to the main hydraulic system through port 185.

If the hydraulic pressure downstream of flow regulating valve 120 does not actuate relief valve 130 or hand valve relief valve 41, hydraulic fluid flow may continue to first refuse cart lifter 20 through line 45 if the hand valve is positioned to raise the lifter, or line 47 if the hand valve is positioned to lower the lifter. Hydraulic fluid flow from first refuse cart lifter 20 returns to first hand valve 40 through line 47 if the operator raises the lifter, or line 45 if the operator lowers the lifter. Hydraulic fluid returned to first hand valve 40 flows back to priority flow hydraulic diverter control assembly 100 through line 43. Hydraulic fluid from priority flow hydraulic diverter control assembly 100 returns to either the main hydraulic system through line 187 or the hydraulic system tank 192, again dependent on the set point of pressure sequence valve 140 and the hydraulic pressure in line 187. Check valve 195 prevents backflow from main hydraulic system line 187 into priority flow hydraulic diverter control assembly 100.

Figure 11:
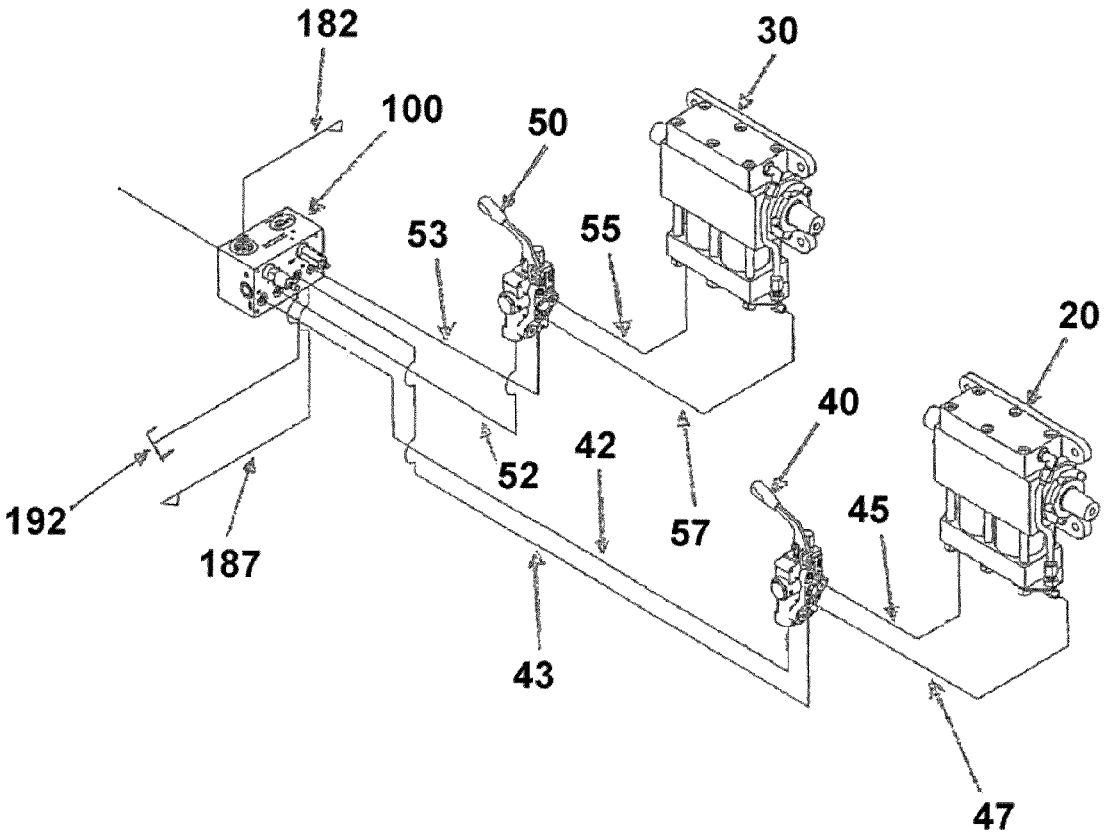
FIG. 11 is a perspective view illustrating the hydraulic connections between the present priority hydraulic flow diverter control assembly and hand valves controlling dual refuse cart lifters.

FIG. 11 depicts the hydraulic connection and hydraulic fluid flow path between the main components of a typical refuse cart lifter hydraulic circuit configured to operate a first refuse cart lifter 20 and a second refuse cart lifter 40. The refuse collection vehicle hydraulic system pump (not shown) pumps hydraulic fluid through supply line 182 and into priority flow hydraulic diverter control assembly 100 at threaded connection 180. Hydraulic fluid flow metered by priority flow hydraulic diverter control assembly 100 flows to a first hand valve 40 through line 42, and a second hand valve 50 through line 52. Depending on the position of first and second hand valves 40 and 50, hydraulic fluid flow may continue to first and/or second refuse cart lifters 20 and 30 through lines 45 and/or 55 respectively if the operator wishes to raise the lifter, or lines 47 and/or 57 respectively if the operator wishes to lower the lifter. If first and second hand valves 40 and 50 are positioned to block hydraulic fluid flow to first and second refuse cart lifters 20 and 30, hydraulic fluid may be diverted downstream of first and second refuse cart lifters 20 and 30 via diverter control assembly relief valve 130 or hand valve relief valves 41 and 51 (see FIG. 12).

Hydraulic fluid flow from first refuse cart lifter 20 returns to first hand valve 40 through line 47 if the operator raises the lifter, or line 45 if the operator lowers the lifter. Hydraulic fluid returned to first hand valve 40 flows back to priority flow hydraulic diverter control assembly 100 through line 43. Hydraulic fluid flow from second refuse cart lifter 30 returns to second hand valve 50 through line 57 if the operator raises refuse cart lifter 30, or line 55 if the operator lowers refuse cart lifter 30. Hydraulic fluid returned to second hand valve 50 flows back to priority flow hydraulic diverter control assembly 100 through line 53.

Again, priority flow hydraulic diverter control assembly 100 returns the hydraulic fluid flowing from refuse cart lifters 20 and 30 to either the main hydraulic system through line 187 or the hydraulic system tank 192. The flow path from priority flow hydraulic diverter control assembly 100 depends upon the position of pressure sequence valve 140.

FIG. 12 is used to explain the operation of priority flow hydraulic diverter control assembly 100 and its individual components, including the hydraulic fluid flow path within priority flow hydraulic diverter control assembly 100, when priority flow hydraulic diverter control assembly 100 is configured to operate a first refuse cart lifter 20 and a second refuse cart lifter 30. As in the single lifter configuration, refuse collection vehicle hydraulic system pump (not shown) pumps hydraulic fluid through supply line 182 and into priority flow hydraulic diverter control assembly 100 at threaded connection 180. Flow is then directed into a first flow regulating valve 120 and a second flow regulating valve 127. The flow regulating valve having the highest hydraulic pressure immediately downstream of the flow regulating valve will position dual sequence valve 152 to direct a portion of the flow out of that flow regulating valve to differential pressure sensing valve 110.

If the hydraulic pressure in line 182 is high enough to overcome the spring force of differential pressure sensing valve 110 and the force applied to differential pressure sensing valve 110 by pressure downstream of control orifice 147, a portion of the flow from line 182 will flow through differential pressure sensing valve 110 to main hydraulic supply line 187. This keeps the differential pressure across flow regulating valves 120 and 127 low, but adequate for normal operation of both first refuse cart lifter 20 and second refuse cart lifter 30.

Hydraulic fluid from first flow regulating valve 120 exits priority flow hydraulic diverter control assembly 100 at threaded port 160 and may flow via line 42 towards first hand valve 40. Similarly, hydraulic fluid from second flow regulating valve 127 exits priority flow hydraulic diverter control assembly 100 at threaded port 165 may flow via line 52 towards second hand valve 50. If the hydraulic pressure immediately downstream of flow regulating valves 120 or 127 is high enough to overcome the spring force of relief valve 130 or hand valve relief valves 41 and 51, i.e. meets or exceeds the set point of relief valves 130, 41, or 51, hydraulic fluid from one or both of flow regulating valves 120 and 127 will flow either back to the main hydraulic system through port 185 or to the hydraulic system tank 192 through port 190. The flow path taken by the hydraulic fluid from the outlet of relief valves 130, 41 and 51 is dependent on the predetermined set point of pressure sequence valve 140 and the hydraulic pressure in line 187.

Similar to the single lifter configuration of priority flow hydraulic diverter control assembly 100, if the hydraulic pressure in line 187 is high enough to overcome the spring force of pressure sequence valve 140, i.e. meets or exceeds the predetermined set point of pressure sequence valve 140, hydraulic fluid exiting priority flow hydraulic diverter control assembly 100 will flow to the hydraulic system tank 192 through port 190. If the hydraulic pressure in line 187 is not high enough to overcome the spring force of pressure sequence valve 140, i.e. is below the predetermined set point of pressure sequence valve 140, hydraulic fluid will flow to the main hydraulic system through port 185.

If the hydraulic pressure downstream of flow regulating valves 120 and 127 does not actuate relief valves 130, 41, or 51, hydraulic fluid flow may continue to first refuse cart lifter 20 through line 45 if first hand valve 40 is positioned to raise first refuse cart lifter 20, or line 47 if first hand valve 40 is positioned to lower first refuse cart lifter 20. Similarly, hydraulic fluid flow may continue to second refuse cart lifter 30 through line 55 if second hand valve 50 is positioned to raise second refuse cart lifter 30, or line 47 if second hand valve 50 is positioned to lower second refuse cart lifter 30. Hydraulic fluid flow from first refuse cart lifter 20 returns to first hand valve 40 through line 47 if the operator raises the lifter, or line 45 if the operator lowers the lifter.

Hydraulic fluid returned to first hand valve 40 flows back to priority flow hydraulic diverter control assembly 100 through line 43. Similarly, hydraulic fluid returned to second hand valve 50 flows back to priority flow hydraulic diverter control assembly 100 through line 53. Hydraulic fluid from priority flow hydraulic diverter control assembly 100 returns to either the main hydraulic system through line 187 or the hydraulic system tank 192, again dependent on the set point of pressure sequence valve 140 and the hydraulic pressure in line 187. Check valve 195 prevents backflow from main hydraulic system line 187 into priority flow hydraulic diverter control assembly 100.

Although the present priority flow hydraulic diverter control assembly 100 has been described using specific terms, devices, and methods, such description is for illustrative purposes only. The words used are words of description rather than of limitation. It is to be understood that changes and variations may be made by those of ordinary skill in the art without departing from the spirit or the scope of the present invention, which is set forth in the following claims. In addition, it should be understood that aspects of the present priority flow hydraulic diverter control assembly may be interchanged both in whole or in part. Therefore, the spirit and scope of the appended claims should not be limited to the description of the preferred versions contained therein.

The invention claimed is:

1. A refuse collection vehicle hydraulic system, the system comprising:

a hydraulic pump in fluid communication with a hydraulic fluid tank;

a main hydraulic fluid line, the hydraulic pump operable to create hydraulic pressure in the main hydraulic fluid line;

a refuse cart lifter;

a refuse cart lifter hydraulic supply line in fluid communication with the main hydraulic fluid line;

a diverter control assembly, the diverter control assembly in fluid communication with the refuse cart lifter hydraulic supply line, the diverter control assembly comprising:

a pressure sequence valve, the pressure sequence valve configured to sense the hydraulic pressure in the main hydraulic fluid line;

wherein the pressure sequence valve is configured to direct hydraulic fluid flow downstream of the refuse cart lifter into the main hydraulic fluid line without passing through the hydraulic fluid tank when the hydraulic pressure sensed by the pressure sequence valve is below a predetermined set point.

2. The refuse collection vehicle hydraulic system of claim 1, wherein the pressure sequence valve includes an adjustable biasing force; and wherein the predetermined set point is a pressure at which the sensed hydraulic pressure acts to overcome the adjustable biasing force.

3. The refuse collection vehicle hydraulic system of claim 2, wherein the adjustable biasing force is an adjustable spring.

4. The refuse collection vehicle hydraulic system of claim 1, wherein the predetermined set point is approximately 1300 psi.

5. A refuse collection vehicle hydraulic system, the system comprising:

a hydraulic pump in fluid communication with a hydraulic fluid tank;

a main hydraulic fluid line, the hydraulic pump operable to create hydraulic pressure in the main hydraulic fluid line;

a refuse cart lifter;

a refuse cart lifter hydraulic supply line in fluid communication with the main hydraulic fluid line;

a diverter control assembly, the diverter control assembly in fluid communication with the refuse cart lifter hydraulic supply line, the diverter control assembly comprising:

a flow regulating valve in the refuse cart lifter hydraulic supply line, the flow regulating valve configured to regulate hydraulic fluid flow to the refuse cart lifter;

a differential pressure sensing valve, the differential pressure sensing valve in fluid communication with the main hydraulic fluid line and the refuse cart lifter hydraulic supply upstream of the flow regulating valve;

wherein the differential pressure sensing valve is configured to divert hydraulic fluid flow from the refuse cart lifter hydraulic supply line upstream of the flow diverting valve into the main hydraulic fluid line when the main hydraulic fluid line pressure is at or above a predetermined set point, such that the differential pressure across the flow regulating valve is reduced and an operational amount of flow to the refuse cart lifter is maintained.

6. The refuse collection vehicle hydraulic system of claim 5, wherein the differential pressure sensing valve includes an adjustable biasing force; and wherein the predetermined set point is a pressure at which the main hydraulic fluid line pressure upstream of the diverter control assembly acts to overcome the adjustable biasing force.

7. The refuse collection vehicle hydraulic system of claim 6, wherein the adjustable biasing force is an adjustable spring.

8. The refuse collection vehicle hydraulic system of claim 6, wherein the differential pressure sensing valve further comprises:

a pressure sensing line; the pressure sensing line in fluid communication with the outlet of the flow regulating valve, the pressure sensing line also in fluid communication with the differential pressure sensing valve;

a control orifice located in the sensing line, the control orifice regulating the hydraulic fluid flow in the sensing line; and wherein the adjustable biasing force further includes a force caused by the pressure in the pressure sensing line.

9. The refuse collection vehicle hydraulic system of claim 8, wherein the control orifice is machined into the diverter control assembly.

10. The refuse collection vehicle hydraulic system of claim 8, wherein the control orifice is removeably connected to the diverter control assembly.

11. The refuse collection vehicle hydraulic system of claim 8, further comprising:

a second refuse cart lifter;

a second flow regulating valve, the second flow regulating valve having an inlet in fluid communication with the main hydraulic fluid line upstream of the diverter control assembly and an outlet in fluid communication with the second refuse cart lifter, the second flow regulating valve configured to regulate hydraulic fluid flow to the refuse cart lifter from the main hydraulic fluid line;

a dual sequence valve, the dual sequence valve in fluid communication with the outlet of the first flow regulating valve and the outlet of the second flow regulating valve, the dual sequence valve also in fluid communication with the pressure sensing line; and wherein the dual sequence valve is configured to open a flow path to the sensing line from the outlet having a greater hydraulic pressure.

12. A method for improving the operation of a refuse collection vehicle hydraulic system, the system including a hydraulic pump in fluid communication with a hydraulic fluid tank, the hydraulic pump operable to create hydraulic pressure in a main hydraulic fluid line, a refuse cart lifter a refuse cart lifter hydraulic supply line in fluid communication with the main hydraulic fluid line and a diverter control assembly, the diverter control assembly in fluid communication with the refuse cart lifter hydraulic supply line, the diverter control assembly including a pressure sequence valve, the method comprising:

sensing with the pressure sequence valve a hydraulic pressure in the main hydraulic fluid line, directing a hydraulic fluid flow from downstream of the refuse cart lifter and into the main hydraulic fluid line without passing through the hydraulic fluid tank when the hydraulic pressure sensed by the pressure sequence valve is below a predetermined set point.

13. The method of claim 12, wherein the predetermined set point is approximately 1300 psi.

14. The method of claim 12, wherein the pressure sequence valve includes an adjustable biasing force that acts against a force resulting from the sensed hydraulic pressure in the main hydraulic fluid line downstream of the diverter control assembly; and wherein the predetermined set point is a pressure at which the sensed hydraulic pressure overcomes the adjustable biasing force.

15. The method of claim 14, wherein the adjustable biasing force is an adjustable spring force.

16. A method for improving the operation of a refuse collection vehicle hydraulic system, the system including a hydraulic pump in fluid communication with a hydraulic fluid tank, the hydraulic pump operable to create hydraulic pressure in a main hydraulic fluid line, a refuse cart lifter a refuse cart lifter hydraulic supply line in fluid communication with the main hydraulic fluid line and a diverter control assembly, the diverter control assembly in fluid communication with the refuse cart lifter hydraulic supply line, the diverter control assembly including a flow regulating valve and a differential pressure sensing valve, the method comprising:

diverting a portion of a hydraulic fluid flow from a refuse cart lifter hydraulic supply line upstream of a flow regulating valve into the main hydraulic fluid line when the main hydraulic fluid line pressure is at or above a predetermined set point to reduce the differential pressure across the flow regulating valve while maintaining an operational amount of flow to the refuse cart lifter.

17. The method of claim 16, wherein the differential pressure sensing valve includes an adjustable biasing force; and wherein the predetermined set point is the pressure at which the main hydraulic fluid line pressure upstream of the diverter control assembly acts to overcome the adjustable biasing force.

18. The method of claim 17, wherein the adjustable biasing force is an adjustable spring.

19. The method of claim 17, wherein the differential pressure sensing valve further comprises:

a pressure sensing line; the pressure sensing line in fluid communication with the outlet of the flow regulating valve, the pressure sensing line also in fluid communication with the differential pressure sensing valve;

a control orifice located in the sensing line, the control orifice regulating the hydraulic fluid flow in the sensing line; and wherein the predetermined set point is the pressure at which the main hydraulic fluid line pressure upstream of the diverter control assembly acts to overcome the adjustable biasing force and a force caused by the pressure in the pressure sensing line.

20. The method of claim 19, wherein the control orifice is machined into the diverter control assembly.

21. The method of claim 19, wherein the control orifice is removeably connected to the diverter control assembly.

22. The method of claim 19, wherein the refuse collection vehicle hydraulic system further comprises:

a second refuse cart lifter;

a second flow regulating valve, the second flow regulating valve having an inlet in fluid communication with the main hydraulic fluid line upstream of the diverter control assembly and an outlet in fluid communication with the second refuse cart lifter, the flow regulating valve configured to regulate hydraulic fluid flow to the refuse cart lifter from the main hydraulic fluid line;

a dual sequence valve, the dual sequence valve in fluid communication with the outlet of the first flow regulating valve and the outlet of the second flow regulating valve, the dual sequence valve also in fluid communication with the pressure sensing line;

wherein the dual sequence valve is configured to open a flow path to the sensing line from the outlet of the flow regulating valve having the greater hydraulic pressure.

* * * * *